United States Patent [19]

Williams et al.

[11] 4,314,305

[45] Feb. 2, 1982

[54] SOLENOID DRIVE CIRCUITS

[75] Inventors: Malcolm Williams, Solihull; John P. Southgate, Georgeham; Richard G. Woodhouse, Hall Green, all of England

[73] Assignee: Lucas Industries Limited, Birmingham, England

[21] Appl. No.: 196,427

[22] Filed: Oct. 14, 1980

Related U.S. Application Data

[63] Continuation of Ser. No. 34,043, Apr. 27, 1979, abandoned, which is a continuation of Ser. No. 923,741, Jul. 11, 1978, abandoned.

[30] Foreign Application Priority Data

Jul. 20, 1977 [GB] United Kingdom ..... 30393/77

[51] Int. Cl.[3] ..... F02M 52/00

[52] U.S. Cl. ..... 361/154; 361/186; 123/490

[58] Field of Search ..... 361/154, 153, 186, 187; 123/32 EF, 32 EA, 32 EH, 32 EL

[56] References Cited

U.S. PATENT DOCUMENTS

| | | | |
|---|---|---|---|
| 3,582,734 | 6/1971 | Bryden | 361/187 |
| 3,609,495 | 9/1971 | Seeselberg | 361/156 X |
| 3,786,314 | 1/1974 | Misch | 361/154 |
| 3,852,646 | 12/1974 | Mason | 361/154 |
| 3,909,681 | 9/1975 | Campari et al. | 361/154 |
| 3,946,285 | 3/1976 | Beery et al. | 361/153 |

*Primary Examiner*—J. D. Miller
*Assistant Examiner*—L. C. Schroeder
*Attorney, Agent, or Firm*—Ladas & Parry

[57] ABSTRACT

A solenoid drive circuit includes two output transistors in parallel paths of relatively high and low resistance respectively. The low resistance path transistor is controlled by a voltage comparator arranged to compare the voltage across a common current sensing resistor with a reference voltage. When the input to the circuit is low, the high resistance path transistor is biased on, but where the current is below a set level, only the low resistance path transistor conducts. Only when the comparator changes state as the solenoid current exceeds its set level does switching off of the low resistance path transistor permit the other transistor to turn on. A delay circuit is included which operates to prevent the low resistance path transistor turning on if there is a short circuit across the solenoid.

9 Claims, 1 Drawing Figure

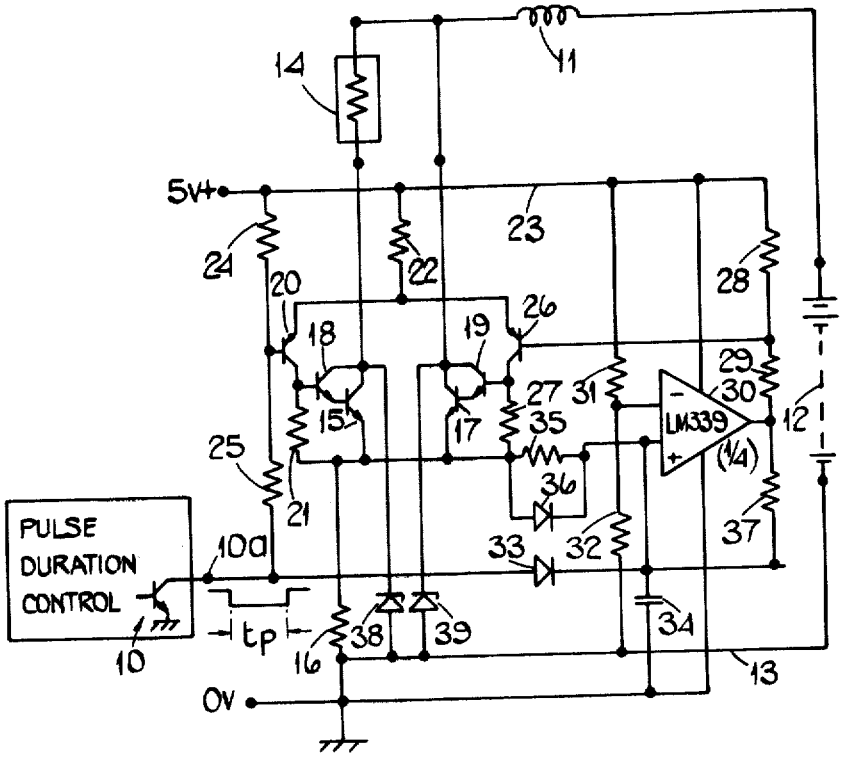
14
11
5V+
23
24
22
28
20
26
18
19
29
30
27
31
15
17
35
LM339
(1/4)
12
25
36
21
37
PULSE
DURATION
CONTROL
10a
33
32
tp
38
39
34
10
16
13
0V

SOLENOID DRIVE CIRCUITS

This is a continuation of application Ser. No. 034,043 filed on Apr. 27, 1979 (abandoned) which was a continuation of application Ser. No. 923,741 filed on July 11, 1978 (abandoned).

This invention relates to solenoid drive circuits particularly (but not exclusively) intended for use in electronically controlled fuel injection systems for internal combustion engines.

In a fuel injection system it is customary to control the rate at which fuel flows to the engine by controlling the duration of pulses which are applied to a solenoid actuated injection valve at a frequency dependent on engine speed. It is already known that the time taken for current to build up in the solenoid sufficiently to open the valve can be significant as compared with the pulse duration and this must be taken into account when designing the circuit which produces the pulses. Moreover the current build-up time varies as a function of battery voltage so that a battery voltage compensation provision may also become necessary.

Generally speaking, the solenoid is connected in series with a ballast resistor with a value chosen to give a reasonable compromise between speed of operation and the steady current level and it is the ballast resistor and coil inductance which determine the current build-up time.

It has previously been proposed to improve the speed of operation of a solenoid by utilizing a two stage control, i.e., one in which the solenoid is caused to open quickly by applying a higher voltage pulse at the solenoid at the commencement of each opening period. Such systems have not, however, in the past included any provision for ensuring proper operation of the solenoid when the battery voltage is low.

A solenoid drive circuit in accordance with the invention includes first and second output transistors connected to the solenoid and providing parallel solenoid current paths of relatively high and low resistance respectively, means connected to an input terminal for permitting either transistor to conduct when the signal at the input terminal is in a first state and preventing both transistors from conducting when the signal is in a second state, and solenoid current sensing means controlling said second transistor so that said second transistor conducts when the signal at the input terminal is in said first state until the solenoid current rises above a predetermined level.

With such an arrangement the start of the first state of input signal causes the second transistor to start conducting, so that solenoid current rises rapidly until it exceeds said predetermined level. The second transistor then switches off and the first transistor conducts. If the supply voltage is normal an adequate solenoid current is maintained. If, however, the supply voltage is so low than an adequate holding current through the solenoid is not maintained then the second transistor will switch on again.

The second transistor may be controlled by a voltage comparator connected to compare the voltage on a common resistor connected between the emitters of the transistors and a first supply rail, with a reference voltage. To provide short circuit protection, the comparator may be associated with a delay circuit which delays application of the current signal to the comparator at the start of said first state of the input terminal signal such that if, as a result of the solenoid being shorted out, the current in the sensing resistor rises above the predetermined level during this delay, the second transistor will not be turned on.

If desired, the comparator may be provided with a positive feedback path so as to operate with hysteresis. In this case the solenoid current level at which the second transistor switches off as the solenoid current is rising is higher than that at which it switches on as the solenoid current is falling again.

An example of the invention is shown in the accompanying drawing which is the circuit diagram of the solenoid drive circuit of an electronically controlled internal combustion engine fuel injection system.

The circuit shown in the drawing includes a pulse duration control 10 which is sensitive to various engine parameters and periodically produces an output pulse during which the input terminal 10*a* to the solenoid drive circuit is in a first state and is effectively grounded. At other times, the input terminal is in a second state and is at a high voltage. The details of the control 10 form no part of the present invention and will not be described herein.

The solenoid 11 which controls a fuel injection valve in the fuel injection system is connected at one end to the positive terminal of a battery 12, the negative terminal of which is connected to an earth rail 13. There are two parallel paths through which the solenoid 11 can be energised, namely a path constituted by a ballast resistor 14 (of about 3 Ohms value), a first npn output transistor 15 and a current sensing resistor 16, and a path constituted by a second npn output transistor 17 and the sensing resistor 16. The emitters of the two transistors 15 and 17 are connected together and are also connected by the resistor 16 to the rail 13.

The transistor 15 has its base connected to the emitter of an npn drive transistor 18 which has its collector connected to the collector of transistor 15 so that these two transistor operate as a Darlington pair. Similarly an npn drive transistor 19 is associated with the second output transistor 17.

The base of the drive transistor 18 is connected to the collector of a pnp control transistor 20 and is also connected by a resistor 21 to the emitter of the transistor 15. The emitter of the transistor 20 is connected by a resistor 22 to a +5 v stabilised supply rail 23 and its base is connected to the junction of two resistors 24 and 25 connected in series between the rail 23 and the input terminal 10*a*.

The base of the transistor 19 is connected to the collector of pnp control transistor 26 and also, by a resistor 27, to the emitter of the transistor 17. The emitter of the transistor 26 is connected to the emitter of the transistor 20 and its base is connected to the junction of two resistors 28 and 29 connected in series between the rail 23 and the output terminal of an integrated circuit voltage comparator 30 (one quarter of a National Semiconductors integrated circuit type LM339). The ratio of the ohmic values of resistors 28 and 29 is higher than that of resistors 24 and 25 so that when the outputs of the control 10 and the comparator 30 are both low, the transistor 26 conducts sufficient current in resistor 22 from the transistor 20 so that the latter is turned off.

The comparator 30 has its inverting input terminal connected to the junction of two resistors 31, 32 which are in series between the rails 23 and 13, so as to apply a reference voltage to this input terminal. The non-inverting input terminal of the comparator 30 is connected to the cathode of a diode 33 which has its anode connected to the terminal 10*a*. This non-inverting input terminal is also connected by a capacitor 34 to the rail 13 and by a resistor 35 to the emitters of the output transistors 15, and 17. A diode 36 is connected in parallel with the resistor 35, with its cathode connected to the non-inverting input terminal. Finally to impart hysteresis to the operation of the comparator, a positive feedback resistor 37 is connected between the output terminal of the comparator 30 and its non-inverting input terminal.

The diode 33, the capacitor 34 and the resistor 35 form a delay circuit which delay switching of the comparator 30 briefly after the signal at input terminal 10*a* goes low-whilst the signal at this terminal 10*a* is high capacitor 34 is charged to the input voltage, and when the signal goes low the capacitor 34 can only discharge via the resistor 35. The capacitor 34 and the resistor 35 have a time constant of about 25 μS so that switching of the comparator is delayed only briefly.

When the signal at the terminal 10*a* is low and the brief delay has elapsed, the output of the comparator 30 goes low and causes the transistor 26 to turn on so that transistors 17 and 19 also conduct, thereby causing the current in the solenoid to increase rapidly. When the current increases to such a level that the voltage across the resistor 16 (which is of very low ohmic value e.g. one sixth of an ohm) exceeds the voltage on the noninverting input terminal of the comparator 30, the output of the comparator 30 now goes high, thereby switching off transistors 17, 19 and 26 and allowing transistors 15, 18 and 20 to turn on. When the battery voltage is normal the solenoid current now falls, but not sufficiently low for the comparator 30 to be switched again, i.e., the solenoid current settles to a value such that the voltage on resistor 16 is lower than the upper threshold voltage required to switch the comparator off but higher than the lower threshold voltage required to switch the comparator on again. The transistor 15 thus remains conductive until the output of the control 10 goes high again.

In the event that the battery voltage is so low that the holding current falls below that required to sustain the comparator 30 in its off state, the comparator 30 output will go low again and cause the solenoid current to increase rapidly to the upper threshold and this cycle will continue to be repeated until the output of the control 10 goes high. The rate of decay of the solenoid current after transistor 17 turns off depends on the battery voltage so that the frequency of the high current pulses caused by periodically turning on the transistor 17 will increase as the battery voltage falls, thereby maintaining a sufficient mean current in the solenoid even when the battery voltage becomes very low.

In the event of a short circuit fault in solenoid 11, the delay circuit mentioned above comes into use as a delay circuit. During the delay transistor 17 is rendered nonconductive, so that transistor 15 is allowed to conduct. If the solenoid 11 is short circuited, the transistor 15 has a purely resistive load constituted by the ballast resistor 14, so that the current in the sensing resistor 16 rises instantaneously and ensures that the comparator 30 does not switch on at the end of the delay period. The resistor 14 is of such value that the current it passes in these circumstances is not high enough to damage the transistor 15.

When this short circuit condition occurs at a time when the battery voltage is very low, it may occur that the current which passes through the resistor 16 during the switch on delay is not adequate to prevent the comparator turning on. In these circumstances the transistor 17 will turn on and the current will rise rapidly until the comparator turns off again. Such rise in the current will, however, cause capacitor 34 to charge up somewhat via resistor 35 and the diode 36 and there will therefore be a delay after the comparator 30 turns off before it can turn on again. Thus it is only required for the transistor 17 to carry high current spikes and it is thus possible to ensure that the power dissipation of transistor 17 is kept below the limit which can be tolerated by this transistor.

The circuit is also protected against various other faults, such as the breakage or detachment of a connection to either of the transistor 15 or the solenoid 11. When such a fault occurs the transistor 17 will turn on as usual after the initial delay but when the comparator 30 switches off as the upper current threshold is exceeded, the transistor 15, although biased on, does not pass any current and the current in the resistor 16 falls immediately. Once again the capacitor 34, resistor 35 and diode 36 operate to introduce a delay before the comparator 30 switches on again and transistor 27 is thereby protected against overheating.

The circuit shown also includes two zener diodes 38, 39, connected between the collectors of the transistor 15 and 17 and rail 13. These are intended to protect the transistors 15 and 17 against the high voltage transient produced whenever the solenoid current is interrupted. It will be noted that current flowing through these zener diodes by-passes the resistor 16 and does not, therefore, interfere with the operation of the circuit in its short circuit mode or its ballast resistor disconnected mode. For a 12 v system the zener diodes are chosen to have a breakdown voltage of say 55 v. This arrangement permits faster dissipation of the solenoid energy at switch off, than the conventional arrangement in which a diode is connected across the solenoid or a capacitor and resistor in series are connected across the collector emitter of the output transistor.

We claim:

1. A solenoid drive circuit including first and second output transistors connected to the solenoid and providing parallel solenoid current paths of relatively high and low resistance respectively, means connected to an input terminal for permitting either transistor to conduct when the signal at the input terminal is in a first state and preventing both transistors from conducting when the signal is in a second state, and solenoid current sensing means controlling said second transistor so that said second transistor conducts when the signal at the input terminal is in said first state until the solenoid current rises above a predetermined level, said output transistors having their emitters connected to a first supply rail by a common resistor forming part of said solenoid current sensing means and having their collectors connected to one terminal of said solenoid by respective high and low resistance means, the other terminal of said solenoid being connected to a second supply rail.

2. A solenoid drive circuit as claimed in claim 1 in which said solenoid current sensing means includes a voltage comparator conected to compare the voltage on said common resistor with a reference voltage.

3. A solenoid drive circuit including first and second output transistors connected to the solenoid and providing parallel solenoid current paths of relatively high and low resistance respectively, means connected to an input terminal for permitting either transistor to conduct when the signal at the input terminal is in a first state and preventing both transistors from conducting when the signal is in a second state, and solenoid current sensing means controlling said second transistor so that said second transistor conducts when the signal at the input terminal is in said first state until the solenoid current rises above a predetermined level, said output transistors having their emitters connected to a first supply rail by a common resistor forming part of said solenoid current sensing means and having their collectors connected to one terminal of said solenoid by respective high and low resistance means, the other terminal of said solenoid being connected to a second supply rail, said solenoid current sensing means including a voltage comparator connected to compare the voltages on said common resistor with a reference voltage.

4. A solenoid drive circuit as claimed in claim 3 further comprising a delay circuit associated with said comparator to delay application of the voltage on the common resistor to the comparator at the commencement of the first state of the input terminal signal such that if, as a result of the solenoid being shorted out, the current in the common resistor rises above the predetermined level during the delay, the second transistor is not turned on.

5. A solenoid drive circuit as claimed in claim 4 in which said delay circuit comprises a capacitor connecting said one terminal of the comparator to said first supply rail and a resistor connecting said one terminal to the emitters of the output transistors.

6. A solenoid drive circuit as claimed in claim 5 further comprising a further diode in parallel with said delay circuit resistor so to prevent any delay in turning off of the second output transistor when the solenoid current exceeds its predetermined value.

7. A solenoid drive circuit as claimed in claim 2 in which the voltage comparator is provided with a positive feedback path so that it operates with hysteresis, the upper and lower threshold levels for the comparator being respectively said predetermined level and a second level corresponding to a current lower than that which will flow in the solenoid with only said first output transistor conducting at a normal supply voltage.

8. A solenoid drive circuit as claimed in claim 2 further comprising first and second control transistors having their collectors connected to control the first and second output transistors respectively, a common resistor connecting the emitters of said control transistors to a supply conductor, a first resistor chain connecting the input terminal to the supply conductor, a second resistor chain connecting the output terminal of the voltage comparator to the supply conductor, the bases of the first and second control transistors being connected to points on respective ones of said first and second resistor chains, the arrangement being such that turning on of said second control transistor by the voltage comparator causes turning off of said first control transistor.

9. A solenoid drive circuit as claimed in claim 1 further comprising a pair of zener diodes connecting the collectors of the output transistors to said first rail.

* * * * *